US009391397B2

(12) United States Patent
Jetter et al.

(10) Patent No.: US 9,391,397 B2
(45) Date of Patent: Jul. 12, 2016

(54) CONNECTOR, COUNTER-CONNECTOR AND CONNECTOR ASSEMBLY WITH CLAMP SURFACES AND FIXATION MEANS

(75) Inventors: Rolf Jetter, Darmstadt (DE); Carsten Buck, Heppenheim (DE)

(73) Assignee: TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 13/980,043

(22) PCT Filed: Jan. 6, 2012

(86) PCT No.: PCT/EP2012/050181

§ 371 (c)(1),
(2), (4) Date: Jul. 16, 2013

(87) PCT Pub. No.: WO2012/098025

PCT Pub. Date: Jul. 26, 2012

(65) Prior Publication Data

US 2013/0288509 A1 Oct. 31, 2013

(30) Foreign Application Priority Data

Jan. 17, 2011 (DE) ..... 10 2011 002 794

(51) Int. Cl.
*H01R 13/627* (2006.01)
*H01R 13/639* (2006.01)

(52) U.S. Cl.
CPC ..... *H01R 13/6275* (2013.01); *H01R 13/639* (2013.01)

(58) Field of Classification Search
USPC ..... 439/345, 347, 350, 357, 522, 551, 358, 439/353, 372, 349, 439, 839
See application file for complete search history.

(56) References Cited

U.S. PATENT DOCUMENTS

| | | | | |
|---|---|---|---|---|
| 3,425,025 | A | 1/1969 | Williams | |
| 3,566,336 | A * | 2/1971 | Johnson et al. | 439/353 |
| 4,367,003 | A * | 1/1983 | Frantz | 439/347 |
| 5,123,858 | A * | 6/1992 | Haag et al. | 439/347 |
| 5,192,222 | A | 3/1993 | Krause et al. | |
| 5,320,554 | A * | 6/1994 | Freer et al. | 439/347 |

(Continued)

FOREIGN PATENT DOCUMENTS

| | | |
|---|---|---|
| DE | 4013682 A1 | 10/1991 |
| DE | 4032801 A1 | 4/1992 |

(Continued)

OTHER PUBLICATIONS

International Preliminary Report on Patentability, dated Jul. 17, 2013, issued by the International Bureau of WIPO, Geneva, Switzerland, for PCT/EP2012/050181; 6 pages.

(Continued)

*Primary Examiner* — Alexander Gilman
(74) *Attorney, Agent, or Firm* — Faegre Baker Daniels LLP

(57) ABSTRACT

The invention relates to a plug type connector, a counter-connector and a plug type connector arrangement. In order to protect a contact position (P) of the plug type connector against undesirable displacement relative to the counter-connector of the plug type connector arrangement, without undesirable forces occurring, there is provision according to the invention for the plug type connector and the counter-connector to have clamping faces which extend transversely relative to a connection direction (V) and which are clamped to each other via a fixing means.

12 Claims, 3 Drawing Sheets

(56) References Cited

U.S. PATENT DOCUMENTS

| | | | | | |
|---|---|---|---|---|---|
| 5,409,394 | A | | 4/1995 | Astier | |
| 5,741,150 | A | * | 4/1998 | Stinson et al. | 439/358 |
| 5,775,931 | A | * | 7/1998 | Jones | 439/358 |
| 5,791,932 | A | * | 8/1998 | Hasenfratz | 439/347 |
| 5,941,726 | A | * | 8/1999 | Koegel et al. | 439/358 |
| 5,971,790 | A | * | 10/1999 | Rohde | 439/357 |
| 6,257,913 | B1 | * | 7/2001 | Kropa et al. | 439/353 |
| 7,384,319 | B2 | * | 6/2008 | Kirstein et al. | 439/839 |
| 8,075,331 | B2 | * | 12/2011 | Gazelot et al. | 439/353 |
| RE44,490 | E | * | 9/2013 | Kirstein et al. | 439/839 |

FOREIGN PATENT DOCUMENTS

| | | | |
|---|---|---|---|
| DE | 69307103 | T2 | 4/1997 |
| EP | 0048085 | A1 | 3/1982 |
| JP | S62-098180 | U | 6/1987 |
| JP | H10-189135 | A | 7/1998 |

OTHER PUBLICATIONS

International Search Report and Written Opinion issued by the European Patent Office, dated Apr. 19, 2012, for related International Application No. PCT/EP2012/050181; 10 pages.

Examination Report issued by the German Patent and Trademark Office, dated Sep. 16, 2011, for German priority Application No. 102011002794.7; 7 pages.

Japanese Examination Report Summary (translated in English language), issued by the Japanese Patent Office for Japanese Application No. 2013-548803, and corresponding Examination Report (in Japanese language) dated Aug. 18, 2015, issued by the Japanese Patent Office for Application No. 2013-548803; 4 pages.

* cited by examiner

CONNECTOR, COUNTER-CONNECTOR AND CONNECTOR ASSEMBLY WITH CLAMP SURFACES AND FIXATION MEANS

The invention relates to a plug type connector for connecting to a counter-connector in a connection direction, having an electrical contact device which has at least one contact element, and having at least one fixing element for securing the plug type connector to the counter-connector. The invention further relates to a counter-connector for connecting to a plug type connector, in particular to a plug type connector according to the invention, counter to a connection direction, having an electrical contact device which has at least one contact element, and having at least one fixing element for securing the counter-connector to the plug type connector. The invention further relates to a plug type connector arrangement having at least one plug type connector and at least one counter-connector which are joined together in a connection direction in a contact position, the plug type connector and the counter-connector having fixing elements for securing their plug type connection.

Plug type connectors and counter-connectors having fixing elements for securing a plug type connection of the two connectors to each other are generally known. Locking or screw type connections or connections comprising alignment pins and alignment holes for fixing the plug type connector to the counter-connector are often used. However, positional tolerances of the fixing elements with respect to the contact device or relative to each other may lead to undesirable mechanical tensions which may impair the plug type connection or the positional reliability of the two connectors relative to each other. Furthermore, the positional tolerances may even lead to the position of the plug type connector being overdetermined with respect to the counter-connector or the relative position of the two connectors determined by the fixing elements making closure of the plug type connection of the contact devices impossible.

An object of the invention is therefore to provide a plug type connector, a counter-connector and a plug type connector arrangement whose fixing elements secure the plug type connector and the counter-connector to each other without positional tolerances of the fixing elements impairing the plug type connection.

The object is achieved for the plug type connector mentioned in the introduction in that the fixing element has a clamping face which extends substantially transversely relative to the connection direction and the plug type connector has a fixing means which can be displaced relative to the fixing element, the fixing means abutting the clamping face in the fixing position thereof in order to fix the plug type connector to the counter-connector. For the counter-connector mentioned in the introduction, the object is achieved in that the fixing element has a clamping face which extends substantially transversely relative to the connection direction for securing the counter-connector to the plug type connector. The object is achieved for the plug type connector arrangement mentioned in the introduction in that the fixing means are formed with clamping faces which extend transversely relative to a connection direction and which are orientated in opposing directions, and the plug type connector arrangement has a fixing means which is clamped in its fixing position between the clamping faces.

Owing to the orientation of the clamping faces transversely relative to the connection direction and the non-positive-locking connection of the clamping faces to each other via the fixing means, forces are absorbed in and transversely relative to the connection direction and dissipated in such a manner that the plug type connection is not substantially impaired. The position of the two connectors relative to each other can thus substantially be determined by the contact devices, the position also not being impaired by the fixing means or forces acting thereon. Prior to the contacting of the contact devices with respect to each other, the two connectors are supported on each other in a floating manner by the mutually interacting fixing elements so that the contact devices can become located relative to each other with disruption without being impeded by fixing elements which may be incorrectly positioned.

The solution according to the invention may be further improved by means of various configurations which are advantageous per se and which may be combined with each other as desired. These configurations and the advantages associated with them are set out below, the structural measures and the effects thereof being described purely by way of example for a plug type connector arrangement with only one plug type connector and one counter-connector. Of course, each plug type connector and each counter-connector may have a plurality of contact devices and the plug type connector arrangement may comprise more than one plug type connector and more than one counter-connector.

In a first advantageous configuration, the clamping face of the plug type connector may be directed counter to the connection direction and the clamping face of the counter-connector may be directed in the connection direction. In the assembled state of the plug type connector and the counter-connector, the clamping faces may be arranged so as to be spaced apart from each other in the connection direction and, when directed in opposing directions, may adjoin a common clamping gap. The fixing means may be pressed in this clamping gap, whereby the two connectors are fixed to each other without significant forces being produced transversely relative to the connection direction. Owing to the resultant frictionally engaging connection of the fixing means with the clamping faces of the two connectors, the forces which seek to change the position of the connectors relative to each other are absorbed and dissipated regardless of the direction in which those forces act.

The fixing element of the counter-connector may be constructed as a fixing member which extends in the connection direction and on which the clamping face is provided. The fixing member may protrude beyond the clamping face of the plug type connector counter to the connection direction when the two connectors are in the assembled state in such a manner that the clamping faces delimit the clamping gap which extends transversely relative to the connection direction. The clamping face may be arranged on an undercut of the fixing member in such a manner that the clamping faces are arranged as close as possible to each other transversely relative to the connection direction, or may even overlap each other in the connection direction.

The connection member may be constructed, for example, as a pin which extends counter to the connection direction and the undercut may be constructed as an indentation or protrusion. In particular, the pin may have a clamping head which may be arranged at a free end of the fixing member. Therefore, the fixing member may be constructed, for example, as a mushroom-like fixing pin on whose free end directed counter to the connection direction the clamping head is provided. In particular, the diameter of the clamping head may be greater transversely relative to the connection direction than the diameter of the remaining portion of the fixing member which interacts with the fixing element of the plug type connector.

An upper side of the clamping head facing the clamping face of the counter-connector and directed counter to the connection direction may be constructed with inclined guiding members, whereby the fixing element of the plug type connector can be guided when the two connectors are joined together. The connectors are thus prevented from becoming stuck or misaligned relative to each other during the connection operation and the contact devices of the two connectors are thus at least roughly prepositioned. A fixing element of the counter-connector constructed in this manner further has the advantage that it can be produced in a simple and cost-effective manner, for example, as a punched, pressed or injection-moulded component.

A portion of the fixing means which is arranged between the adjacent clamping faces of the two connectors in the fixing position may be thicker in the connection direction than a portion which is arranged between the clamping faces when the fixing means are in a position remote from the fixing position. In order to be able to insert the fixing means into the clamping gap in a simple manner and nonetheless achieve a clamping force at the desired level, the fixing means may, for example, have a wedge-shaped clamping portion. If the fixing means is pushed into the clamping gap, the part of the clamping portion which has first been pushed into the clamping gap may have a wall thickness which is smaller parallel with the connection direction than the clear width of the clamping gap. Part of the clamping portion which is subsequently pushed into the clamping gap may have a greater wall thickness, it being possible for the wall thickness of this part at least to correspond to the clear width of the clamping gap or even to be slightly larger than the clear width. The fixing means can thereby be readily positioned in the clamping gap and the positive-locking clamping connection can be produced by the clamping portion being further inserted into the clamping gap.

In particular, the clamping portion may be pushed onto the clamping faces transversely relative to the connection direction, a cross-section of the clamping portion being able to taper transversely relative to the connection direction. The clamping portion may rest in a planar manner in particular on the clamping face of the plug type connector. Occurrences of overloading of the fixing element or the fixing means brought about by force peaks are thereby prevented. An upper side of the fixing means directed away from the clamping face of the plug type connector may be constructed as a clamping ramp which extends away from the clamping face of the plug type connector over its path transverse relative to the connection direction. Such a fixing means can be produced in a simple and cost-effective manner, for example, by means of injection-moulding.

The clamping portion may be able to be pushed onto the clamping face in a fitting direction which extends transversely relative to the connection direction. For example, the clamping portion may first be pushed onto the clamping face in the fitting direction and subsequently be pushed into the clamping gap in a clamping direction. The fitting direction and the clamping direction may both extend transversely relative to the connection direction and where applicable transversely relative to each other. In a configuration which is particularly advantageous since it can be readily handled, the positioning and clamping direction may be identical. Consequently, the position of the connectors relative to each other can be safeguarded against undesirable displacement simply by pushing the fixing means onto the respective fixing element.

So that an assembly of the plug type connector and the counter-connector can be at least partially guided, a receiving channel for the fixing element of the counter-connector may extend through the fixing element of the plug type connector. The receiving channel may in particular extend in the connection direction so that rough positioning errors of the connectors relative to each other transversely relative to the connection direction are prevented. The receiving channel may be sized in such a manner that the fixing element of the counter-connector can be readily inserted into the receiving channel. In particular, a clear width of the receiving channel transversely relative to the connection direction may be greater than the maximum extent of portions of the fixing member which are introduced into the receiving channel when the connectors are assembled. The connectors may thus be supported against each other in a floating manner by the fixing elements.

The receiving channel may extend through the clamping face or open therein. In particular, the receiving channel may be guided continuously in the connection direction by the fixing element. It is thereby possible in particular for the pin-like or mushroom-like fixing element of the counter-connector to be able to be inserted into the receiving channel in a simple manner. The receiving channel may be open at one side transversely relative to the connection direction or completely closed, that is to say, formed in a tubular manner. A configuration of the receiving channel which is open at one side may simplify the assembly of the plug type connector arrangement since relatively large movements of the connectors transversely relative to the connection direction are possible. However, this relatively large movement latitude may lead to the contact devices of the connectors not being optimally prepositioned relative to each other. This problem may be prevented by the tunnel-like configuration of the receiving channel.

In order to be able to move the fixing element of the counter-connector through the receiving channel, the clamping face thereof should be formed so as to be smaller than the clear width of the receiving channel. This may lead to the fact that, although the clamping faces of the two connectors are orientated in opposing directions when the connectors are in the assembled state, they do not overlap each other in the connection direction. The clamping gap would therefore be open at least at one side in or counter to the connection direction. So that the clamping portion can nonetheless connect together the clamping faces which do not overlap each other in a non-positive-locking manner, it can at least partially cover the receiving channel in its fixing position. The clamping portion may in particular protrude so far into the receiving channel that it bridges the receiving channel between the two adjacent clamping faces in its fixing position or overlaps both clamping faces in the connection direction and abuts them.

In another advantageous configuration, the fixing means may be fitted to the plug type connector in an assembly position in such a manner that it allows the two connectors to be joined together. In particular, the fixing means may be displaceably and non-removably connected to the fixing element of the plug type connector, the fixing means being able to be fitted in its assembly position to the fixing element of the plug type connector. The assembly of the plug type connector arrangement is thereby substantially simplified. In the assembly position, the fixing means allows simple assembly of the connectors.

For example, the fixing means may be locked to the fixing element in the assembly position. Since a locking connection may also be advantageous in other positions of the fixing means, the fixing means and fixing element may allow different locking positions which are spaced apart from each other transversely relative to the connection direction. For example, locking regions of the fixing element of the plug type connector which interact with a locking element of the fixing means may have a plurality of locking steps which are arranged one behind the other transversely relative to the connection direction. The locking of the fixing means to the fixing element may also additionally secure the position of the fixing means in its fixing position. The position or dimensional tolerances of the plug type connector or the counter-connector can be absorbed by means of corresponding sizing of the locking steps.

In the assembly position of the fixing means, which may be arranged with spacing from the fixing position thereof transversely relative to the connection direction and, for example, counter to the fitting direction, the clamping portion may cover the receiving channel less than in the fixing position or not at all. Owing to the fact that the clamping portion protrudes to a lesser extent into the receiving channel, the fixing element of the counter-connector may be inserted into the receiving channel without colliding with the fixing means.

In order to be able to absorb and dissipate clamping forces in the most symmetrical manner possible, the fixing means may be constructed with two clamping members, which may protrude into the clamping portion. The fixing means may have an assembly opening through which the fixing channel extends at least partially at least in the fixing position of the fixing means. The assembly opening may be bordered by the clamping members transversely relative to the connection direction and may extend at least partially through the clamping portion. The clamping members may be part of a clamping plate of the clamping portion, the assembly opening being able to extend through the clamping plate. Such a configuration of the fixing means simplifies the assembly thereof on the plug type connector and in particular increases the stability of the clamping portion.

An end of the assembly opening directed in the fitting direction may be formed so as to be open so that the fixing means can also be positioned onto the already-assembled connectors of the plug type connector arrangement without the fixing means colliding with the fixing element of the counter-connector.

The clear width of the assembly opening may expand in the clamping direction or in the fitting direction and the assembly opening may be formed with an assembly indentation and a clamping indentation which may be arranged one behind the other. The clear width of the assembly indentation may allow the fixing member to pass through in the connection direction. In particular, the assembly indentation may be arranged in the clamping direction or in the fitting direction upstream of the clamping indentation, whereby simple fitting of the fixing means is also possible in the pre-assembled state of the plug type connectors and when contact devices are connected to each other.

In particular, the clamping indentation may be constructed in a U-shaped manner, the clamping members of the clamping indentation being able to be constructed as clamping edges which are surrounded by the clamping portion and being able to be part of the clamping members.

In order to further increase the stability of the fixing means and to improve the operability thereof, the fixing means may be constructed as a fixing block. The fixing block may be box-like and may be constructed with at least one open end which is directed in the fitting direction so that it can be fitted on the fixing element. Both the clamping plate and a lower plate which is opposite the clamping plate may be provided with the assembly opening, the assembly openings being able to be in alignment with each other in the connection direction. In particular, the clamping plate and the opposing lower plate may be formed identically. This simplifies the assembly of the fixing means since the function thereof is no longer dependent on which plate is directed in the connection direction and is introduced into the clamping gap. Lateral plates which extend transversely relative to the clamping plate may in particular each be provided with the at least one locking element at the end thereof directed in the fitting direction.

A single-point fixing of the two connectors to each other may be inadequate for permanently receiving forces directed towards the plug type connection and to safeguard the plug type connector arrangement against undesired opening of the plug type connection. Furthermore, using a single-point connection, forces can be absorbed only in selected directions. Consequently, in another advantageous configuration, the plug type connector and the counter-connector may each have a plurality of fixing elements, for example, three, which allow securing at several locations. The fixing elements may be arranged, for example, in corners of an equilateral triangle. Such three-point fixing protects the plug type connector and the counter-connector from displacements in all spatial directions.

In order to prevent forces produced by the clamping of the connectors to each other from acting excessively on the contact devices during assembly of the plug type connector arrangement, the fixing means can be pushed in different fitting directions onto the clamping faces or into the clamping gap. So that these pushing forces do not act on the contact devices, the fixing means may be arranged in such a manner that the pushing forces substantially cancel each other out. For example, the fitting directions may be orientated in opposing directions or towards a common point within the triangle.

The invention is explained below by way of example with reference to embodiments and the drawings. The various features of the embodiments may be combined independently of each other, as already set out in the individual advantageous configurations.

The structure and/or function of a plug type connector according to the invention and a counter-connector according to the invention are first described with reference to the embodiment of FIG. 1.

Figure 1:
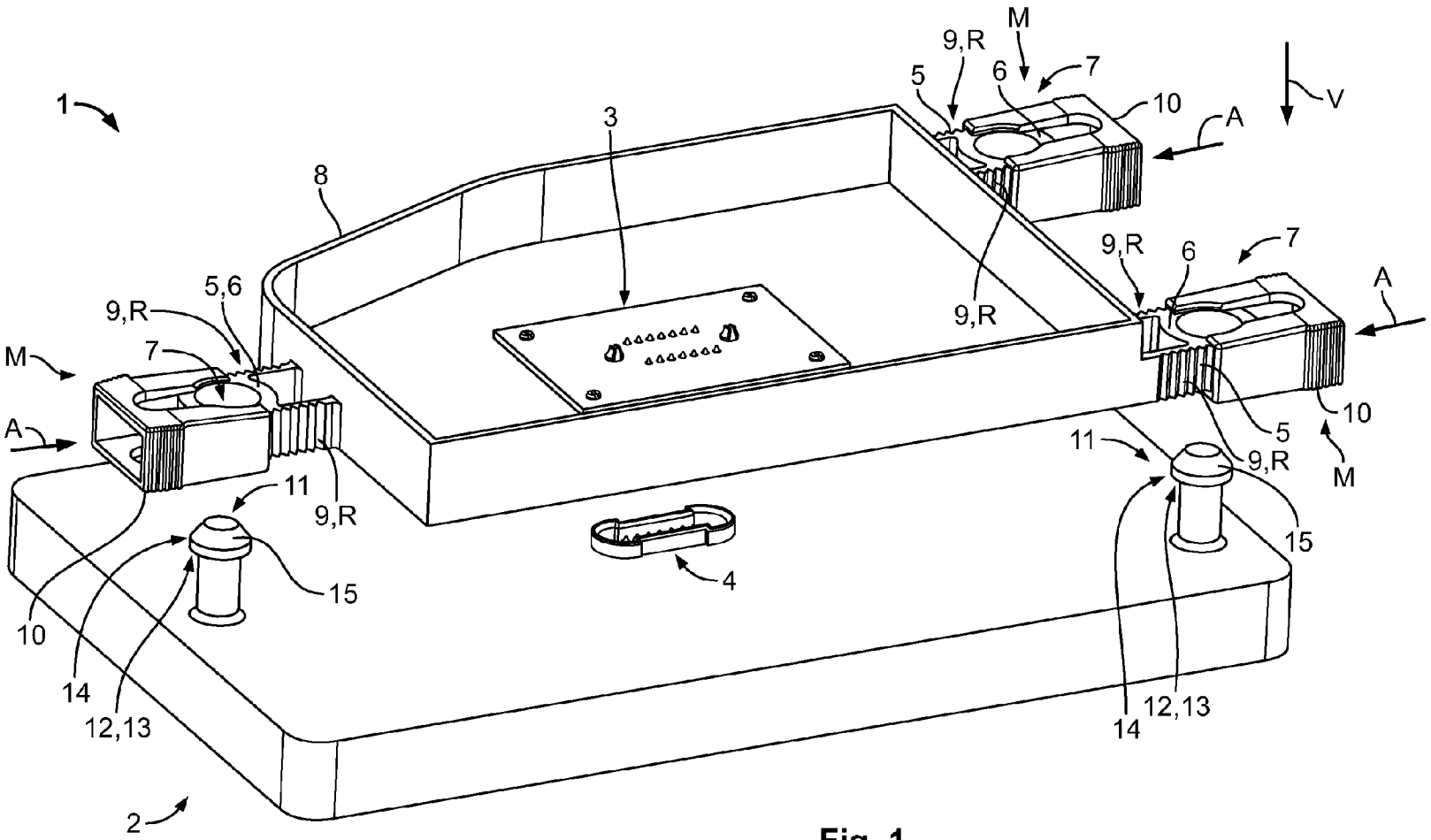
FIG. 1 is a schematic, perspective illustration of an embodiment of a plug type connector according to the invention and a counter-connector according to the invention.

FIG. 1 illustrates the plug type connector 1 and the counter-connector 2. The plug type connector 1 and the counter-connector 2 are arranged spaced apart from each other in a connection direction V. The plug type connector 1 may be configured in such a manner that it can be joined together with the counter-connector 2 in the connection direction V to form a plug type connector arrangement. The plug type connector 1 and the counter-connector 2 may each comprise at least one contact device 3, 4 which can form an electrical plug type connection when the two connectors 1, 2 are in an assembled state.

The plug type connector 1 may have at least one and in particular three fixing elements 5. Each of the fixing elements 5 may be provided with a clamping face 6, it being possible for the clamping faces 6 to extend transversely relative to the connection direction V and to be arranged in particular so as to be directed counter to the connection direction V. Through each of the fixing elements 5, parallel with the connection direction V, there may extend a receiving channel 7 which may in particular extend through the clamping face 6 or open therein. The receiving channel 7 may extend completely through the fixing element 5 in the connection direction V and may be open at one side, for example, transversely relative to the connection direction V, or completely closed and consequently formed in a tubular manner.

The fixing elements 5 may protrude from a housing 8 of the plug type connector 1 transversely relative to the connection direction V and may be formed in particular as fixing protrusions or fixing bars. At lateral faces 9 which border and extend perpendicularly relative to the clamping face 6, the fixing elements 5 may be provided with locking regions R, which may extend transversely relative to the connection direction V.

The plug type connector 1 is illustrated with fixing means 10, the number of which corresponds to the number of fixing elements 5 of the plug type connector 1 and one of which can be positioned on one of the fixing elements 5 at least partially in a fitting direction A which extends transversely relative to the connection direction V. The fitting directions A of the respective fixing means 10 can be orientated differently and, for example, at least partially in an opposing manner. The fixing means 10 are illustrated in their assembly position M, in which they are pushed onto the fixing elements 5 and in particular onto the clamping faces 6 thereof in such a manner that they do not inhibit assembly of the plug type connector 1 and the counter-connector 2.

The counter-connector 2 may also have fixing elements 11, the number of which corresponds to the number of fixing elements 5 of the plug type connector 1 and of which only two fixing elements 11 can be seen in FIG. 1. The fixing elements 5, 11 of the connectors 1, 2 may be arranged in such a manner that they form fixing pairs which interact with each other when the connectors 1, 2 are joined together. The fixing elements 11 of the counter-connector 2 may be constructed, for example, as fixing members which extend counter to the connection direction V. The fixing members which may be pin-like may be sized in such a manner that, when the connectors 1, 2 are in the assembled state, they are at least partially arranged in the receiving channels 7 and protrude at least beyond the clamping faces 6 of the plug type connector 1 counter to the connection direction V.

A free end of the fixing elements 11 of the counter-connector 2 which is directed counter to the connection direction V may have an undercut 12 on which a clamping face 13 which extends transversely relative to the connection direction V is arranged. The undercut 12 may be formed, for example, by a protrusion or indentation of the fixing element 11. The clamping face 13 may in particular be orientated so as to be directed in the opposite direction to the clamping face 11 of the plug type connector 1 and in the connection direction V.

Alternatively, the free end of the fixing element 11 may be constructed with a clamping head 14 whose diameter transversely relative to the connection direction V is greater than the diameter of the remaining portion of the fixing element 11 which is arranged at least temporarily in the receiving channel 7 during the connection operation of the connectors 1, 2. The clamping face 13 may be arranged in particular at a side of the clamping head 7 directed in the connection direction V. Counter to the connection direction V, the clamping head 14 may be constructed with peripheral inclined guiding members 15 which simplify fitting of the fixing element 5 of the plug type connector 1 on the fixing element 11 of the counter-connector 2.

Figure 2:
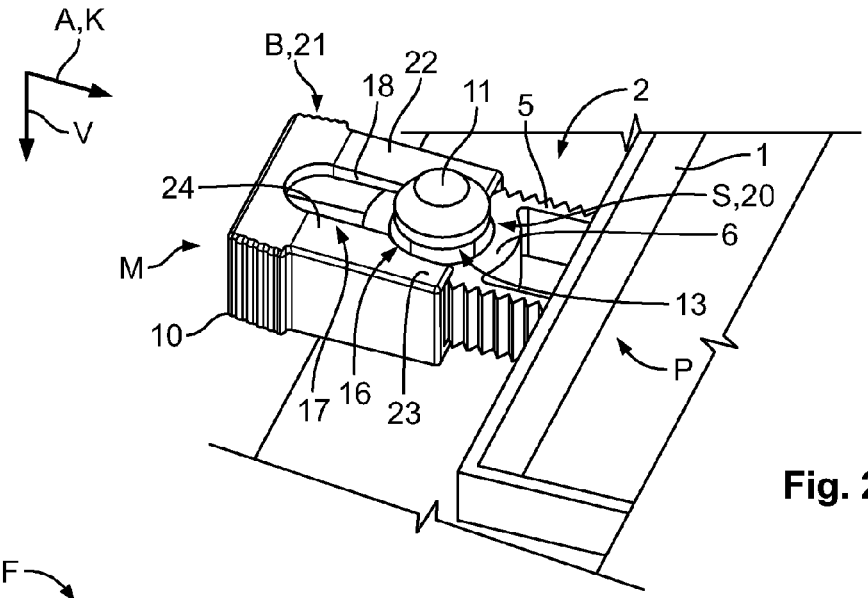
FIGS. 2-4 are schematic, perspective illustrations of fixing elements according to the invention and a fixing means according to the invention.
Figure 3:
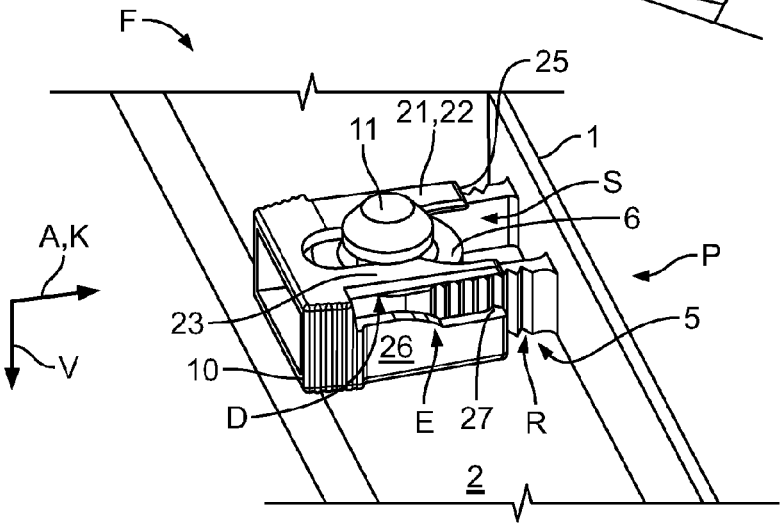
Figure 4:
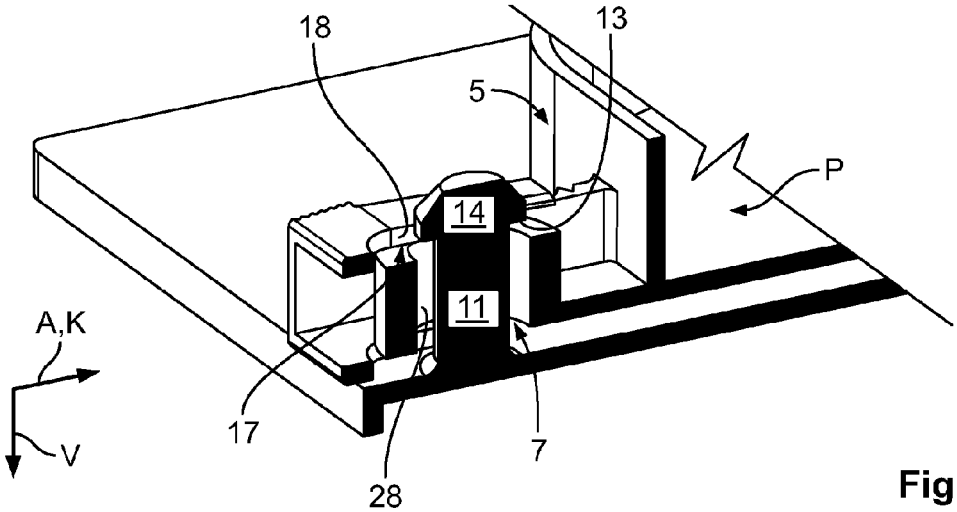

FIGS. 2 to 4 show one of the fixing elements 5 of the plug type connector 1 and one of the fixing elements 11 of the counter-connector 2 together with one of the fixing means 10, drawn to an enlarged scale.

The plug type connector 1, in the illustration of FIG. 2, is fitted on the counter-connector 2 in the connection direction V in such a manner that the contact devices 3, 4 are electrically contacted with each other. In this contact position P, the fixing element 11 of the counter-connector 2 may protrude through the fixing element 5 of the plug type connector 1. In particular, the clamping faces 6 and 13 may be arranged spaced apart from each other in the connection direction V and, at least in the connection direction V, together delimit a clamping gap S which extends transversely relative to the connection direction V.

The fixing means 10 is illustrated in its assembly position M. The fixing element 11 may protrude in the assembly position M of the fixing means 10 through an assembly indentation 16 and in particular be guided through the assembly indentation 16, without colliding with the fixing means 10. A clamping indentation 17 may adjoin the assembly indentation 16, the clamping indentation 17 and the assembly indentation 16 being able to be arranged one behind the other in a clamping direction K which extends transversely relative to the connection direction V and transversely relative to or in the fitting direction A. Transversely relative to the fitting direction A and the connection direction V, the clamping indentation 17 may have a smaller width than the assembly indentation 16 so that a clamping edge 18 of the fixing means 10 that at least partially delimits the clamping indentation 17 can engage in the clamping gap S and can overlap the receiving channel 7 and the clamping face 13 of the counter-connector 2.

The assembly indentation 16 and the clamping indentation 17 can together form an assembly opening 19 of the fixing means 10. The assembly opening 19 may have an open end 20 which is directed in the fitting direction A and which the assembly indentation 16 can adjoin. The clamping indentation 17 may adjoin an end of the assembly indentation 16 directed away from the open end 20.

The assembly opening 19 may in particular extend through a clamping portion 21 of the fixing means 10. Clamping members 22, 23 of the clamping portion 21 may border the assembly opening 19 transversely relative to the connection direction V and transversely relative to the fitting direction A or the clamping direction K. The clamping portion 21 may protrude into the clamping gap S in a fixing position of the fixing means 10 set out below and press against the clamping faces 6, 13. The fixing position may be remote from the illustrated assembly position M in the fitting direction A. If a displacement of the fixing means 10 in the fitting direction A leads to a clamping of the connectors 1, 2, the fitting direction A may correspond to the clamping direction K.

The clamping portion 21 may be formed as a wedge-like clamping plate B, a wall thickness of the clamping plate B to be measured in the connection direction V being able to decrease in the fitting direction A or in the clamping direction K.

The clamping portion 21 may be pushed at least partially in a planar manner onto the clamping face 6 of the plug type connector 1 so that pressure peaks acting on the clamping face 6 are prevented. An upper side of the fixing means 10 directed away from the clamping face 6 and counter to the connection direction V may be constructed as a clamping ramp 24 which may extend away from the clamping face 6 counter to the fitting direction A or counter to the clamping direction K.

FIG. 3 illustrates the embodiment of FIGS. 1 and 2, the fixing means 10 being illustrated in its fixing position F. In the fixing position F, the fixing means 10 is pushed further onto the clamping face 6 of the plug type connector 1 in the fitting direction A or in the clamping direction K compared with its assembly position M. The clamping portion 21 and in particular the clamping members 22, 23 thereof are pushed through the clamping gap S further in the clamping direction K. In the clamping direction K, the clamping portion 21 may have a thinner introduction end 25 which can be arranged in the clamping direction K in the fixing position F behind the fixing element 11 of the counter-connector 2. The introduction end 25 may abut the assembly indentation 16 and be part of the clamping portion 21. In the clamping direction K upstream of the introduction end 25, the clamping portion 21 may be constructed with a relatively large and even increasing wall thickness in the connection direction V. The wall thickness in this clamping region D, which is arranged in the fixing position F at least partially between the clamping faces 6, 13 and in the clamping gap S, may at least correspond to the extent of the clamping gap S in the connection direction V. Both the clamping edge 18 and the clamping indentation 17 may be arranged in this clamping region D.

Transversely relative to the fitting direction A and the connection direction V, the fixing means 10 may be formed so as to be hollow-cylindrical and be formed in particular in a substantially complementary manner to the fixing element 5 of the plug type connector 1. In particular, the fixing means 10 may be constructed as a fixing block which can be pushed onto the fixing element 5.

The fixing means 10 is illustrated with a recess E in order to be able to depict the securing of the fixing means 10 to the fixing element 5 of the plug type connector 1. In particular, a lateral plate 26 is illustrated only partially in FIG. 3 in order to provide an insight into the non-releasable connection between the fixing means 10 and fixing element 5. At the end thereof directed in the fitting direction A, at least the lateral plate 26 may have a locking element 27 which is directed towards the locking region R. This locking element 27 may interact with locking steps of the locking region R and retain the fixing means 10 on the fixing element 5 at least in the assembly position M or in the fixing position F or in positions located between these positions M, F in a non-releasable and displaceable manner.

FIG. 4 is a sectioned illustration of the embodiment of FIG. 3 taken in the fitting direction A, the plane of section extending substantially centrally through the fixing elements 5, 11. In this illustration, it can be seen that the receiving channel 7 has, transversely relative to the connection direction V, a larger diameter than the fixing element 11 and in particular than the clamping head 14 thereof. The clamping indentation 17 may also be constructed in such a manner that it does not abut faces of the fixing element 11 of the counter-connector 2 extending in the connection direction V. In this instance, the spacing of an inner wall 28 of the receiving channel 7 and the clamping edge 18 with respect to the sides of the fixing element 11 extending in the connection direction V may be selected to be so large that occurrences of positional tolerances of the fixing elements 5, 11 with respect to each other or to the contact devices 3, 4 do not lead to contact with the sides of the fixing element 11 which extend in the connection direction V. A transfer of force to the contact devices 3, 4 via these sides transversely relative to the connection direction V is consequently impossible.

Figure 5:
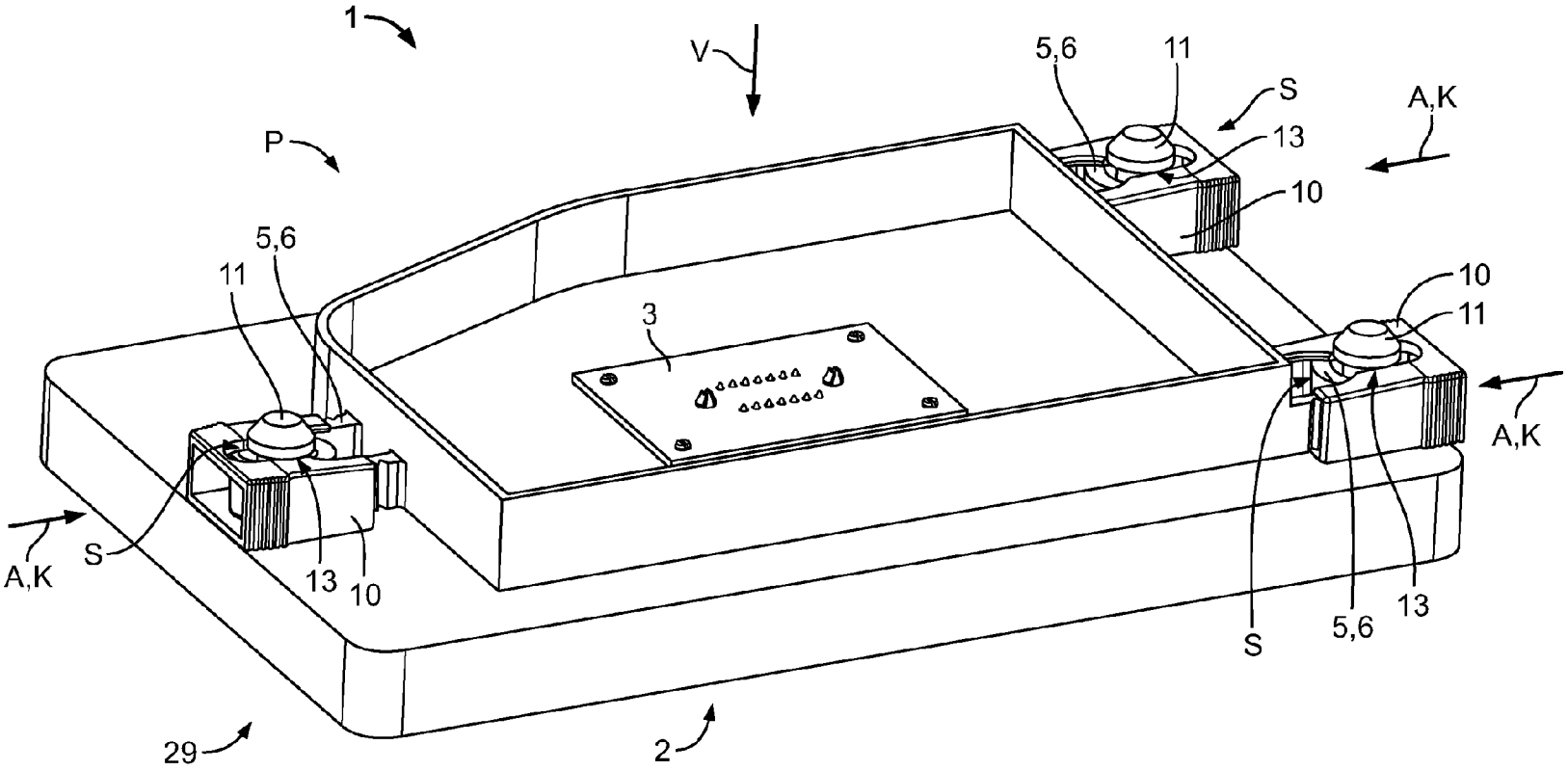
FIG. 5 is a schematic, perspective illustration of a plug type connector arrangement according to the invention which is protected from undesired disengagement.

FIG. 5 illustrates the assembled plug type connector arrangement 29 with the plug type connector 1 and the counter-connector 2. The plug type connector 1 may be fitted on the counter-connector 2 until it reaches the illustrated contact position P in the connection direction V so that the contact devices 3, 4 are electrically contacted with each other. The fixing elements 5, 11 engage so far in each other that the clamping faces 6, 13 are spaced apart from each other in the connection direction V and delimit the clamping gap S in the connection direction V. The fixing means 10 are pushed into the clamping gaps S in their fitting or clamping directions A, K and pressed between the clamping faces 6, 13, respectively. Owing to the non-positive-locking press-fit connection of the clamping faces 6, 13 with the fixing means 10, not only movements parallel with respect to the connection direction V but also transverse movements relative to the connection direction V can be prevented. This securing of the contact position P of the connectors 1, 2 relative to each other can be carried out without producing forces which have a detrimental effect on the connection of the contact devices 3, 4.

In order to also ensure that, owing to the fitting of the fixing means 10, no forces which occur transversely relative to the connection direction V act on the contact devices 3, 4, the fitting or clamping directions A, K may be orientated in opposing directions. If the fixing means 10 are now moved at the same time from their assembly position M into their fixing position F, assembly forces which occur may substantially cancel each other out. In this regard, it may be advantageous for the fixing elements 5, 11 to be arranged in pairs, that is to say, a fixing element 5 and a fixing element 11 in each case, in corners of a triangle and in particular an equilateral triangle. The fitting or clamping directions A, K may then be orientated in an opposing manner or towards a common point within the triangle.

The invention claimed is:

1. Plug type connector for connecting to a counter-connector in a connection direction (V), having an electrical contact device which has at least one contact element, and having at least one fixing element for securing the plug type connector to the counter-connector, wherein the fixing element has a clamping face which extends substantially transversely relative to the connection direction (V) and the plug type connector has a fixing means which can be displaced relative to the fixing element, the fixing means abutting the clamping face in the fixing position (F) thereof in order to fix the plug type connector to the counter-connector, wherein a receiving channel extends through the fixing element and the clamping face in the connection direction (V) wherein the fixing means has an assembly opening through which the receiving channel at least partially extends in the fixing position (F) of the fixing means.

2. Plug type connector according to claim 1, wherein the clamping face is directed counter to the connection direction (V).

3. Plug type connector according to claim 1, wherein the fixing means has a wedge-shaped clamping portion, which can be pushed onto the clamping face and whose cross-section tapers transversely relative to the connection direction (V).

4. Plug type connector according to claim 3, wherein the clamping portion can be pushed onto the clamping face in a fitting direction (A) which extends transversely relative to the connection direction (V).

5. Plug type connector according to claim 1, wherein a clear width of the receiving channel transversely relative to the connection direction (V) is greater than the maximum extent of a fixing element of the counter connector which is introduced into the receiving channel when the connectors are assembled.

6. Plug type connector according to claim 1, wherein an end of the assembly opening directed in the fitting direction (A) is formed so as to be open.

7. Plug type connector according to claim 1, wherein the fixing means is displaceably and non-releasably connected to the fixing element.

8. Plug type connector for connecting to a counter-connector in a connection direction (V), having an electrical contact device which has at least one contact element, and having at least one fixing element for securing the plug type connector to the counter-connector, wherein the fixing element has a clamping face which extends substantially transversely relative to the connection direction (V) and the plug type connector has a fixing means which can be displaced relative to the fixing element, the fixing means abutting the clamping face in the fixing position (F) thereof in order to fix the plug type connector to the counter-connector, wherein a receiving channel extends though the fixing element and the clamping face in the connection direction (V) 20, wherein a clear width of the receiving channel transversely relative to the connection direction (V) is greater than the maximum extent of a fixing element of the counter connector which is introduced into the receiving channel when the connectors are assembled and wherein the clamping portion at least partially covers the receiving channel in the fixing position (F) thereof.

9. Plug type connector for connecting to a counter-connector in a connection direction (V), having an electrical contact device which has at least one contact element, and having at least one fixing element for securing the plug type connector to the counter-connector, wherein the fixing element has a clamping face which extends substantially transversely relative to the connection direction (V) and the plug type connector has a fixing means which can be displaced relative to the fixing element, the fixing means abutting the clamping face in the fixing position (F) thereof in order to fix the plug type connector to the counter-connector, wherein a receiving channel extends through the fixing element and the clamping face in the connection direction (V), wherein a clear width of the receiving channel transversely relative to the connection direction (V) is greater than the maximum extent of a fixing element of the counter connector which is introduced into the receiving channel when the connectors are assembled and wherein the clamping portion in an assembly position (M) remote from the fixing position (F) covers the receiving channel less than in the fixing position (F) or not at all.

10. Plug type connector for connecting to a counter-connector in a connection direction (V), having an electrical contact device which has at least one contact element, and having at least one fixing element for securing the plug type connector to the counter-connector, wherein the fixing element has a clamping face which extends substantially transversely relative to the connection direction (V) and the plug type connector has a fixing means which can be displaced relative to the fixing element, the fixing means abutting the clamping face in the fixing position (F) thereof in order to fix the plug type connector to the counter-connector, wherein a receiving channel extends through the fixing element and the clamping face in the connection direction (V), wherein the plug type connector has a plurality of fixing elements, which are arranged in the corners of an equilateral triangle and on whose clamping faces fixing means can be pushed in different fitting directions (A), the fitting directions (A) being orientated in opposing directions or towards a common point within the triangle.

11. Counter-connector for connecting to a plug type connector, in particular to a plug type connector according to claim 1, counter to a connection direction (V), having an electrical contact device which has at least one contact element, and having at least one fixing element for securing the counter-connector to the plug type connector, wherein the fixing element has a clamping face which extends substantially transversely relative to the connection direction (V) in order to secure the counter-connector to the plug type connector.

12. Counter-connector according to claim 11, wherein the fixing element is formed as a fixing member which extends in the connection direction (V) with an undercut, the clamping face being arranged on the undercut so as to be directed in the connection direction (V).

* * * * *